United States Patent [19]

Wattles et al.

[11] 4,113,191

[45] Sep. 12, 1978

[54] LAMINATED ROTOR PROCESSING APPARATUS

[75] Inventors: Gurdon B. Wattles, North Haven; Louis R. Vecsey, Wallingford, both of Conn.

[73] Assignee: Entoleter, Inc., Hamden, Conn.

[21] Appl. No.: 778,363

[22] Filed: Mar. 17, 1977

[51] Int. Cl.[2] ..... B02C 13/10

[52] U.S. Cl. ..... 241/188 A; 241/197; 241/275

[58] Field of Search ..... 241/188 R, 188 A, 191, 241/192, 197, 275

[56] References Cited

U.S. PATENT DOCUMENTS

| | | | |
|---|---|---|---|
| 1,576,472 | 3/1926 | Riley | 241/188 A X |
| 1,811,438 | 6/1931 | Riley et al. | 241/188 A X |
| 2,013,800 | 9/1935 | Daniels | 241/188 A X |
| 2,639,863 | 5/1953 | Rogers | 241/197 X |
| 2,867,387 | 1/1959 | Dodds et al. | 241/188 A UX |
| 2,922,589 | 1/1960 | Sheldon | 241/197 X |
| 3,157,366 | 11/1964 | Rogers | 241/197 X |
| 3,503,561 | 3/1970 | Johnson | 214/188 R |

*Primary Examiner*—Howard N. Goldberg
*Attorney, Agent, or Firm*—Nelson E. Kimmelman

[57] ABSTRACT

Rotary processing apparatus is shown having a horizontal rotor made up of a number of flat annular plates secured together to which material processing members such as centrifugal impactors are releasably secured. Stator processing members or impactors are shown which are adjustable from outside the rotor housing. In another form, a rotor operating in a vertical plane and having processing members or impactors on both sides has material to be processed fed to it separately on each side. In both forms, reinforcement of the rotor housing may additionally be achieved by providing a plurality of generally flat annular members secured together and to inside surfaces of the rotor housing. Rotor impactors for the second embodiment have two processing ends and are provided with simple slip-in means for insertion into place through apertures in the laminated rotor.

18 Claims, 9 Drawing Figures

LAMINATED ROTOR PROCESSING APPARATUS

BACKGROUND OF THE INVENTION

1. Field of the Invention

This invention relates to a comminuting apparatus and in particular to a milling apparatus having a rotor with a plurality of impacting elements against which particulate material to be processed is impelled by centrifugal force at high speed.

2. Prior Art

Previous rotary processing apparatus was known in which a rotor was attached to a motor-driven spindle, the rotor comprising a generally disc-like unitary or integral piece to which a number of processing elements such as centrifugal impactors were attached. When these rotors processed hard or abrasive material, localized abrasion caused localized wear patterns which required relatively expensive repair and refinishing. Also, these rotor processing members were often arranged to cooperate with stator processing members whose axial orientation could not be altered easily or, if alterable could not be altered from outside the rotor housing making replacement, repair or reorientation expensive and time-consuming. Moreover, the art did not teach practical double-sided rotor constructions which enabled double input of material to be processed to both sides of the rotor, nor was such construction known in which the rotor impactors were double-ended and easily inserted or removed from either side of the rotor.

It is therefore among the objects of the present invention to meet the deficiencies of the stated prior art and to provide other advantages as will be seen below.

SUMMARY OF THE INVENTION

Rotary processing apparatus which includes, in a rotor housing, a rotor having a plurality of substantially flat, generally centrally apertured members arranged in a stack, the apertures being aligned to permit a spindle to be coupled to the rotor. In one form, the stack is associated with processing members on both sides and means are provided to apply material to be processed to both sides simultaneously. In another form, the processing members are double-ended and may be inserted into the stack or removed therefrom easily. In still another form, there are a plurality of stator processing members extending inwardly from the rotor housing to cooperate with the rotor processing members. The stator members, according to another feature of the invention, are mounted in one or more sides of the rotor housing so that predetermined ones may have their axial orientation adjusted from outside the rotor housing.

In yet another embodiment, a second stack of flat, generally centrally apertured members is disposed adjacent one or more interior wall surfaces of the rotor housing to define with the rotor stack a processing zone for the input material.

DETAILED DESCRIPTION OF THE DRAWINGS — FIGS. 1-5

Figure 1:
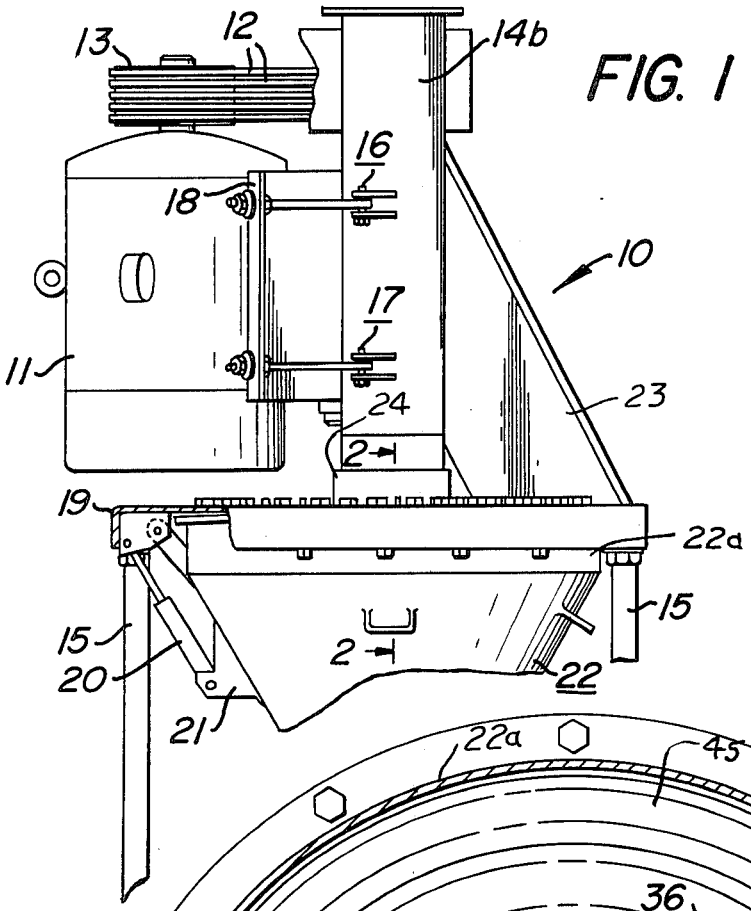
FIG. 1 is a fragmentary, side elevation view of one form of the present invention.

Referring to FIGS. 1-5, the apparatus indicated generally at the numeral 10 shows the external appearance of one form of the present invention. A heavy duty motor 11 is mounted on a plate 18 that is, itself, mounted to two chutes **14*a*, 14*b*. The spacing of plate 18 from chutes 14*a*, 14*b* and hence the tension on the belts 12 may be regulated by the pivotal adjustment of it relative to the pivot pins 16 and 17. These chutes have their lower ends supported by a generally rectangular member 24 fixed to the upper cover portion of a rotor housing. The chutes 14*a*, 14*b* are, themselves, partially supported by angle braces 23 which contact the sides of the chutes and the top portion 19** of the rotor housing.

A plurality of belts 12 which engage a sheave 13 attached to the shaft of the motor 11 convey rotary power to the main shaft 27 of the rotor. The shaft is positioned vertically within a shaft column 25 and passes through the portion 24 and the opening **41*a* of portion 41. The lower threaded end 27 of the rotor enters a hub 26 and is kept in place by a threaded member 42 which passes through the center of the retaining disc 44 which is bolted to the hub by a plurality of bolts 48, that pass through a corresponding plurality of vertically aligned apertures in plates 28-33 and screw into threaded apertures formed in hub 26**.

In accordance with the present invention, the rotor, instead of being made of a single piece of constant diameter steel, is made of a plurality of generally annular metallic disc members 28-33 of different diameters. They are retained in place by the action of the rotor disc retainer 44, member 42 and the circular row of bolts 48. As shown, the six rotor plates or discs first respectively increase in diameter from the top down and then decrease in diameter to form a symmetrically arranged vertical stack.

Located toward the periphery of the rotor stack are a plurality of rotor impactors arranged in three concentric rows 38, 39 and 40. The impactors 38 respectively pass through a circular row of vertically aligned apertures in the two central rotor discs 30, 31 whereas the circular rows 39 and 40 of rotor impactors pass through vertically aligned apertures formed in the central four rotor discs 29-32. The innermost circular row of impactors 40 respectively pass through corresponding vertically aligned holes formed in all of the rotor plates or discs 28-33.

Figure 3:
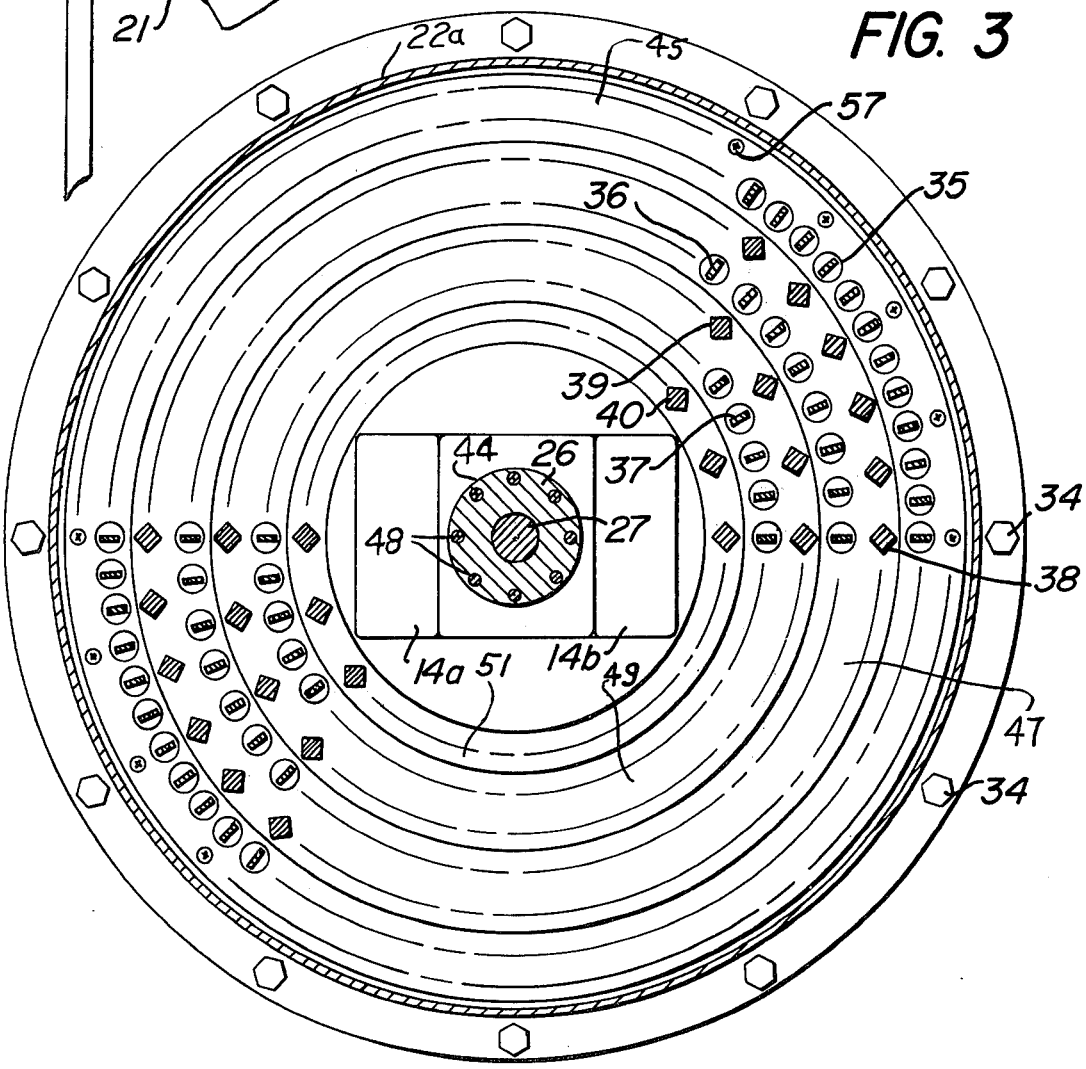
FIG. 3 is a sectional view of the apparatus shown in FIG. 2 taken along the section line 3—3 in the direction indicated.
Figures 2, 4, 5:
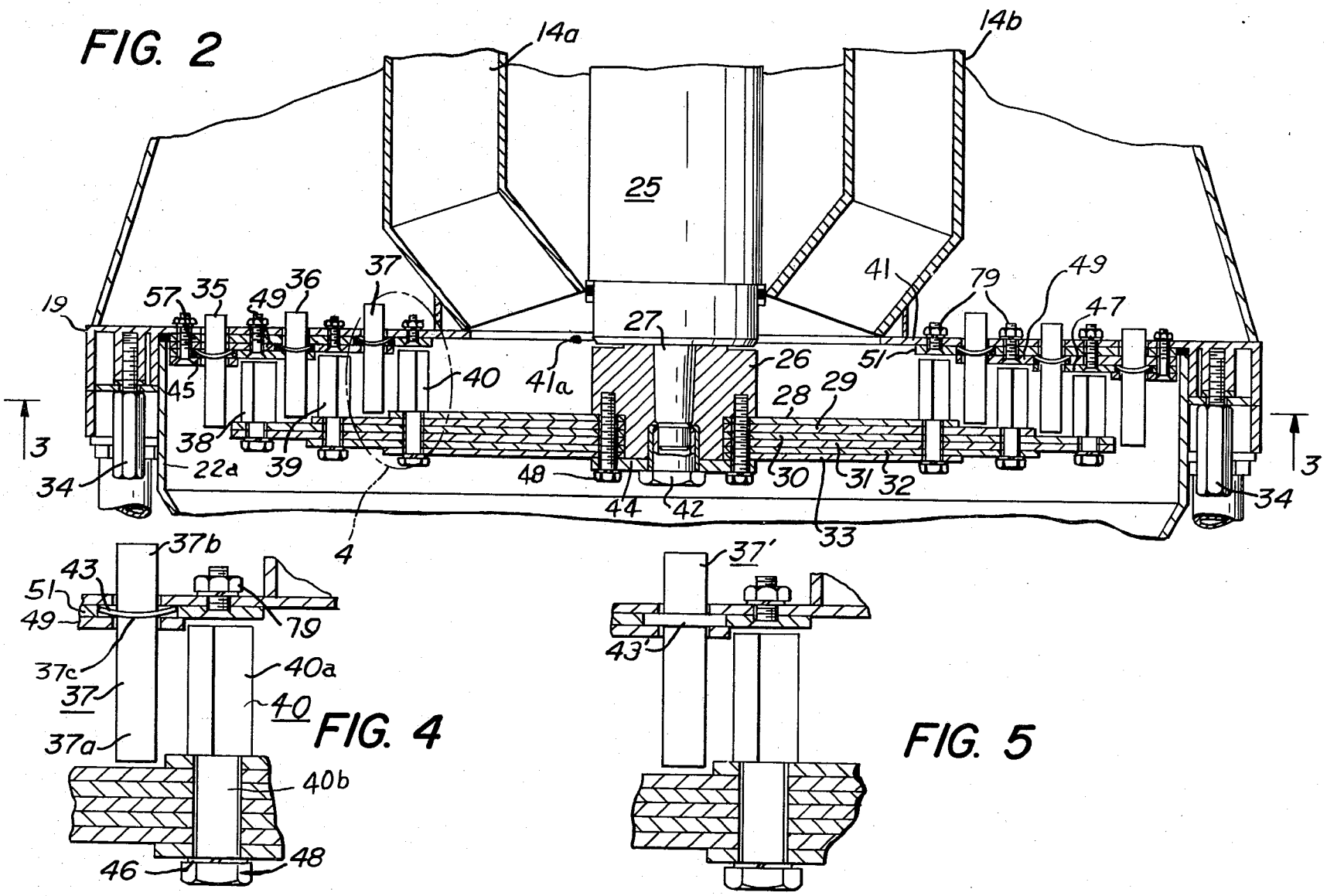
FIG. 2 is a fragmentary sectional view of the apparatus shown in FIG. 1 taken along the section line 2—2 in the direction indicated.
FIG. 4 is an enlarged sectional view of the portion of the apparatus shown in FIG. 2 within the oval broken line marked "4"
FIG. 5 is an enlarged sectional view of a variant of the construction shown in FIG. 4.

The sets of rotor impactors 38, 39 and 40 are retained in place by bolts such as bolts 46 shown in FIG. 4 which pass upward through the aligned holes in the rotor plates and threadedly engage the impactors. The bolts 48 are held in place by lock washers 46. The impactors 40 have an upper portion 40*a* and a lower portion 40*b*. It should be noted that the length of the lower portions 40*b* of the innermost row of rotor impactors is greater than the corresponding portions of the rotors 39 and 38 since they must pass through six thicknesses of rotor discs whereas the impactors 39 and 38 pass through, respectively, four and two of such discs or plates. The input material flows downward through the chutes 14*a*, 14*b* onto the center of rotor plate 28 and then are flung outwardly. The material first hits the innermost row of impactors 40 which have a generally square cross-section as shown in FIG. 3. They are shown arranged so that their impacting surface is at an angle of 45° to radii. There is nothing absolute about this disposition, however, since they may also be arranged at any desired angle of impact relative to the trajectory of the material being processed.

The laminar rotor construction has many advantages. In previous types of rotors which were made of one piece, it often happened that because of localized heavy abrasion, certain portions became worn down and had to be welded. This caused an uneven build-up of the weld material in that area so that the rotor then had to be machined for smoothness. This entailed high labor costs which, today, constitute an increasingly large portion of the total cost of any heavy-duty apparatus. With the present invention, if the top disc 28 is worn down, for example, it is only necessary to replace it with a new top disc and no welding or further processing is required.

The rotor is enclosed by a top rotor housing member 41 and is surrounded by the upper part 22*a* of a hopper 22. This hopper may be pivotally mounted by bracket 21 to a gas spring 20 whose other end is pivotally connected to the supporting frame as shown in FIG. 1 and explained in the copending application of Gurdon B. Wattles et al, Ser. No. 770,365, filed Feb. 22, 1977, now U.S. Pat. No. 4,083,504, issued Apr. 11, 1978. A plurality of bolts 34 passing through holes formed toward the upper periphery of the hopper 22 fasten the hopper to the perimeter portion 19 of the top of the rotor housing. Four vertical posts 15 support the entire structure 10.

When this mill is to be used for processing highly abrasive material, it is also advisable to reinforce the inside surface of the top 41 of the rotor housing. This is done by employing a corresponding plurality of flat annular members 45, 47, 49, 51. In order to keep the vertical cross-section of the impacting processing zone substantially constant, the annuli 45, 47, 49, 51 are arranged so that there are progessively more from the center to the periphery. The annuli are held in place by nut-bolt assemblies 79 which pass through aligned apertures in the top 41 of the rotor housing and in the annuli themselves.

In accordance with another feature of this invention, the apparatus is provided with a plurality of stator impactors which are adjustable in position from outside the rotor housing. As shown, there are three concentric rows of stator impactors 35, 36 and 37 which are staggered in their vertical disposition. That is to say, the lower parts 37*a* of the impactors 37 (and the corresponding parts of the other impactors 36 and 35) are mounted progressively higher from the outside toward the center even though all of the impactors are of substantially the same total length.

In accordance with one embodiment of the present invention, each stator impactor has a slightly dished washer such as Belleville washer 37*c* secured to its vertical side. Each washer is positioned in a hole such as aperture 43 in the corresponding rotor plate which is substantially larger than the holes in the plates through which the upper and lower portions 37*a*, 37*b* of the impactors pass. The curvature of the washers 37*c* and the vertical dimensions of the openings 43 are so chosen with respect to the thicknesses of the plates 45, 47, 49, 51 that when the impactors 35–37 are located as shown in FIG. 2 and the bolt-nut assemblies 79 are tightened, the washers 37*c* are squeezed from above and below by the discs above and below it. However, the frictional squeezing forces of the plates on the washers are such that an operator can nevertheless adjust the angular orientation (on its axis) of each stator impactor by a wrench from above the rotor housing 41.

As shown in FIG. 3, the stator impactors have a generally rectangular cross-section throughout their length (except for the washers) although any desired cross-section may be chosen. As also shown, they are all arranged so that radii drawn from the center of the rotor shaft 27 outwardly would pass through the longitudinal axes of each stator impactor. However, it should be understood that they could be turned from above cover 41 to be at any desired angle for the desired grinding effect. It has been found that different degrees and types of shattering or abrading effects are caused by different angles of impact of the material as flung against the stator impactors.

Instead of the embodiment using the impactor construction previously explained to provide adjustability for the stator impactors, the arrangement shown in FIG. 5 is also viable. In this embodiment, the impactors 37′, for example, have flat washers or rings 43′ attached as shown whose thickness is slightly greater than the vertical clearances between the top of the rotor housing 41 and the plate 51. Therefore, the impactor 37′ may also be adjusted by a wrench from above the cover 41 against the friction exerted by the sandwiching action of the cover and plate 51 on the ring 43′.

ALTERNATE EMBODIMENT — FIGS. 6–9

The previous embodiment featured a milling machine having a horizontal rotor fastened to the lower end of a generally vertical drive shaft so that the rotary processing was in a generally horizontal plane. To increase throughput, it is often desired to have a milling machine with an essentially double-sided vertical rotor and having individual inputs to each side. One such mill has been designed for use with highly abrasive substances such as coal, for example. As the energy shortage has grown, resort to solid fossil fuels is increasingly made. Truck or train transportation of coal has certain disadvantages relative to transport of coal by fluid energy in a pipe line. For this to occur, however, it is necessary to reduce the coal to essentially a fine powder so that when mixed with a carrier fluid such as water, a slurry is formed that can be transported by the pipe lines. Coal, however, is extremely abrasive and therefore extra precautions must be taken to provide a milling apparatus which withstands the abrasion as well as the impact forces generated in milling the coal.

Figure 6:
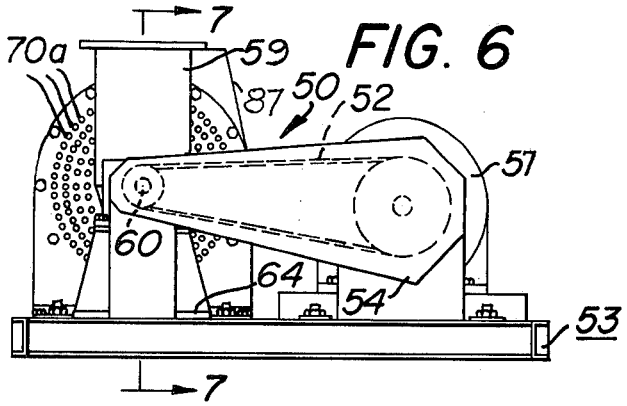
FIG. 6 is a side elevation view of another form of the present invention.

Such a mill 50 is shown in FIG. 6 comprising a drive motor 57, a power transmission belt 52 within a cover 54 and a rotor shaft 60. One of two feed chutes 59 is shown mounted to supporting frame 53. Chute 59 supplies one input to one side of the rotor 61. The horizontal rotor 61 has a shaft which passes through a rotor sleeve 69 which contains bearings, lubrication means, anti-particle labyrinth seals and other customary parts for high speed rotating shafts.

The rotor 61 is comprised of 11 flat annular metallic plates 66 through which the end of the rotor 60 passes. The plates are sandwiched between a $\pi$-sectioned rotor hub 68 on the left and a rotor locking ring 58 on the right. Retaining bolts 65 pass through aligned apertures in the hub 68, in the plates 66, and in the ring 58 whose apertures are threaded. A retaining nut 67 is also used to keep the rotor assembly together.

All of the plates 66 are within vertical planes and, like the rotor of the previous embodiment, have increasingly greater radii toward the center plates and decreasing radii away from the center plates as shown. There are four concentric rings of double-ended wear-reenforced rotor impactors 74, 75, 76, and 78. They are positioned in substantially square, aligned broached holes formed in the plates 66 transversely to the vertical planes of the plates 66 and are progressively shorter in the rows disposed toward the outside of the rotor.

Figure 7:
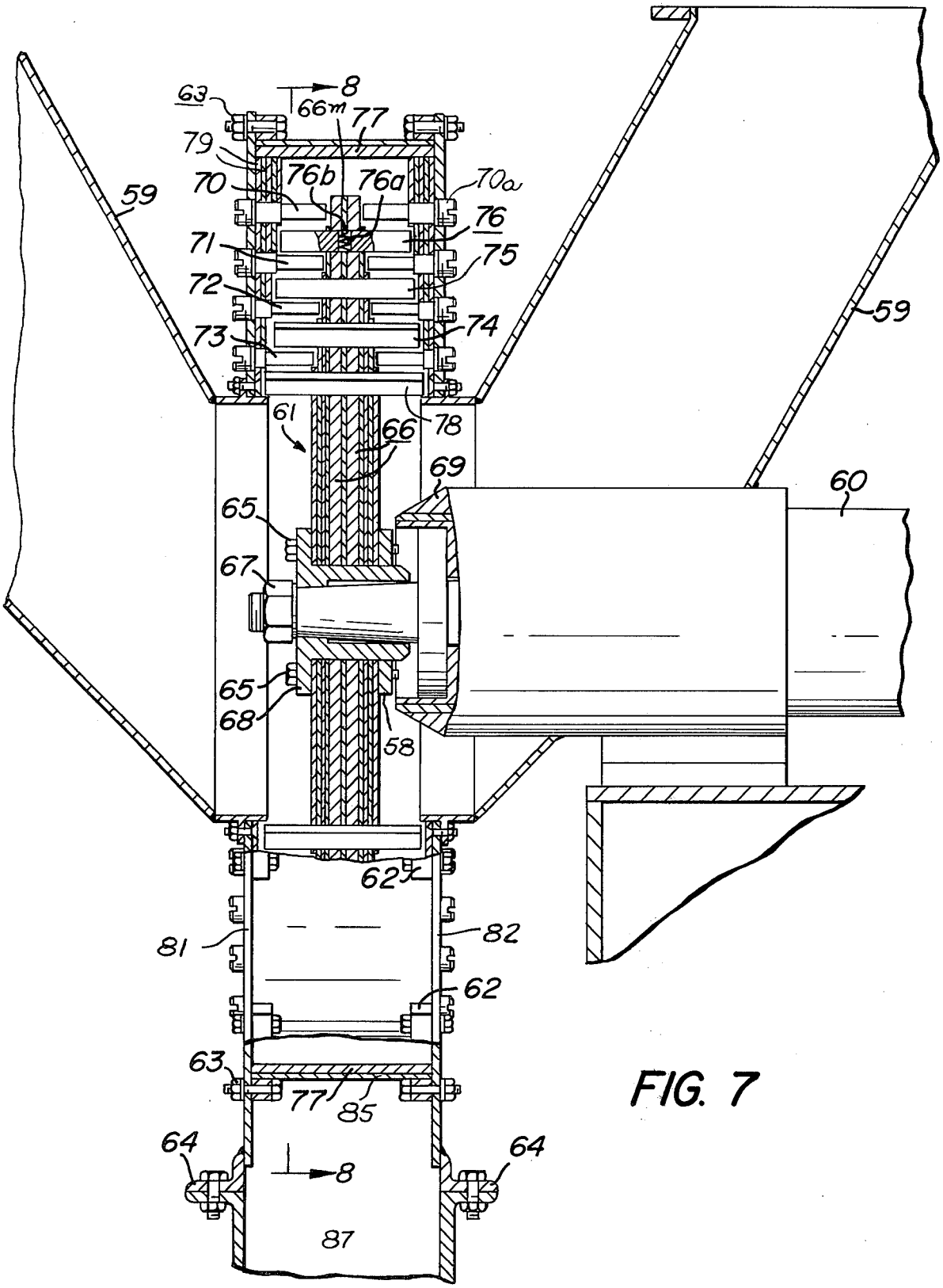
FIG. 7 is a fragmentary sectional view of the apparatus of FIG. 6 taken along the section line 7—7 therein.

The rotor is almost surrounded by a wear-resistant liner 77 abutting the inner wall of a volute 85. The volute has apertured flanged portions 62 connected thereto at intervals which correspond to spaced holes at the edges of rotor covers 81 and 82 so that the discharge end 87 of the volute may be adjusted at a number of desired angles around the axis of the rotor shaft. As viewed in FIGS. 6–8, it is positioned for discharge toward the upper right part of the rotor. When the desired angular position is decided upon, the nut-bolt assemblies 63 are used to fasten the volute in position around most of the rotor housing except toward the outlet where assemblies 64 are employed.

To reinforce the wear-resistant capabilities of the mill, there are a number of annular discs 79 having different radii positioned against the left and right side walls 81 and 82 of the rotor housing. They are, as in the previous embodiment, arranged so that the further they are from the side walls 81, 82, respectively, the smaller is their width, i.e., the larger is their central hole. They may be retained in place by bolt-nut assemblies (not shown) as in FIG. 2 or by any other conventional means. This construction and arrangement serves the same purpose as their counterparts in the embodiment of FIG. 1; i.e., it compensates for the tapering of the rotor thickness and provides a substantially equal processing volume on each side of the rotor from the hub out to its periphery.

Figure 9:
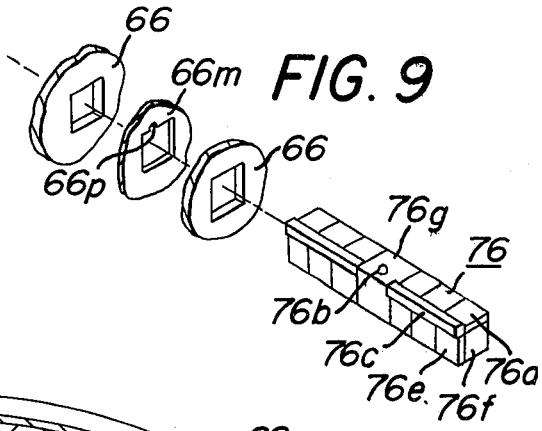
FIG. 9 is an exploded perspective view of one of the rotor impactors shown in FIG. 7 in relation to several of the rotor discs through which it passes.

It is seen that the sets of rotor impactors 74, 75, 76, 78 have relatively little of their total surface area exposed. They are releasably inserted into the circular rows of substantially square apertures formed in the constituent rotor discs 66 so that their respective center portions (such as portion **76*g* of impactors 76, see FIG. 9) are completely shielded from the onslaught of the coal particles flung out against them at high speed. These rotor impactors 76, as may be seen from FIG. 9, have substantially rectangular cross-sections. There is a central steel portion 76*g* which is not treated for extra wear resistance, a plurality of top carbide plates 76*d* which are brazed onto a single untreated steel bar 76*f*. There are corresponding carbide plates 76*e* brazed onto the bar 76*f* on one adjacent side of the impactor. A corner bar 76*c* is a single piece of carbide steel that is also brazed into place. As may be seen, the corner bar 76*c* has a substantially square cross-section whose dimensions are slightly larger then the thicknesses of the plates 76*e* and 76*d*. These corner bars are arranged on the leading edge or surface of the impactors, i.e., the edges or surfaces which first make contact with the material being processed. Being larger than the adjacent wear plates 76*e* and 76*d*, they tend to "shadow" or protect the junctions of the corner bar and the plates 76*e*, 76*d*** where undue abrasion would otherwise occur.

Each rotor impactor such as impactor 76 is provided in its untreated center section **76*g* with a ball 76*b* at the end of a transverse passageway 76*a* in which a spring 76*b* urges it outwardly. As shown, the impactor 76 is passed through substantially square holes formed in the three centrally-located rotor discs 66 and the two discs 66 adjacent thereto on either side thereof (only the central three discs are fragmentarily shown in FIG. 9). Actually, the square holes have slightly larger cross-sections than the cross-section of the impactors to accommodate the extra large cross-section of the bar 76*c*. The middle disc 66*m* has square holes with additional little arcuate cut-out sections 66*p* to act as a detent when the impactor 76 is pushed from one side of the rotor through the discs 66 until ball 76*b* springs out into the section 66*p*. This spring-loaded ball detent is sufficient to maintain the rotor impactors 76 in place since there is practically no force imparted to the impactors in a direction transverse to the centrifugal force vector that would cause them to move axially off center. The location of the cut-outs 66*p* and of the spring-loaded balls 76*b* also prevent the insertion of the impactors into the square holes the wrong way, that is, with the unprotected steel surfaces of bar 76*f* exposed to the flung-out coal particles instead of the surfaces of the plates 76*d* and 76*e* and bar 76*c***.

The dimension of the unprotected steel central portion **76*g* taken in a direction parallel to the longitudinal axis of the impactor 76 and the thicknesses of the five rotor plates through which it passes are so chosen that the junctions of that central portion with the two carbide plates 76*e* on either side and with the two adjoining plates 76*d*** are not exposed to the oncoming coal particles; otherwise those junctions would ordinarily be regions of high wear from impact and abrasion. The same is also true, of course, of all of the other rotor impactors, that is, their respective central unprotected steel portions are dimensioned to be smaller than the combined thicknesses of the plates through which they pass.

Figure 8:
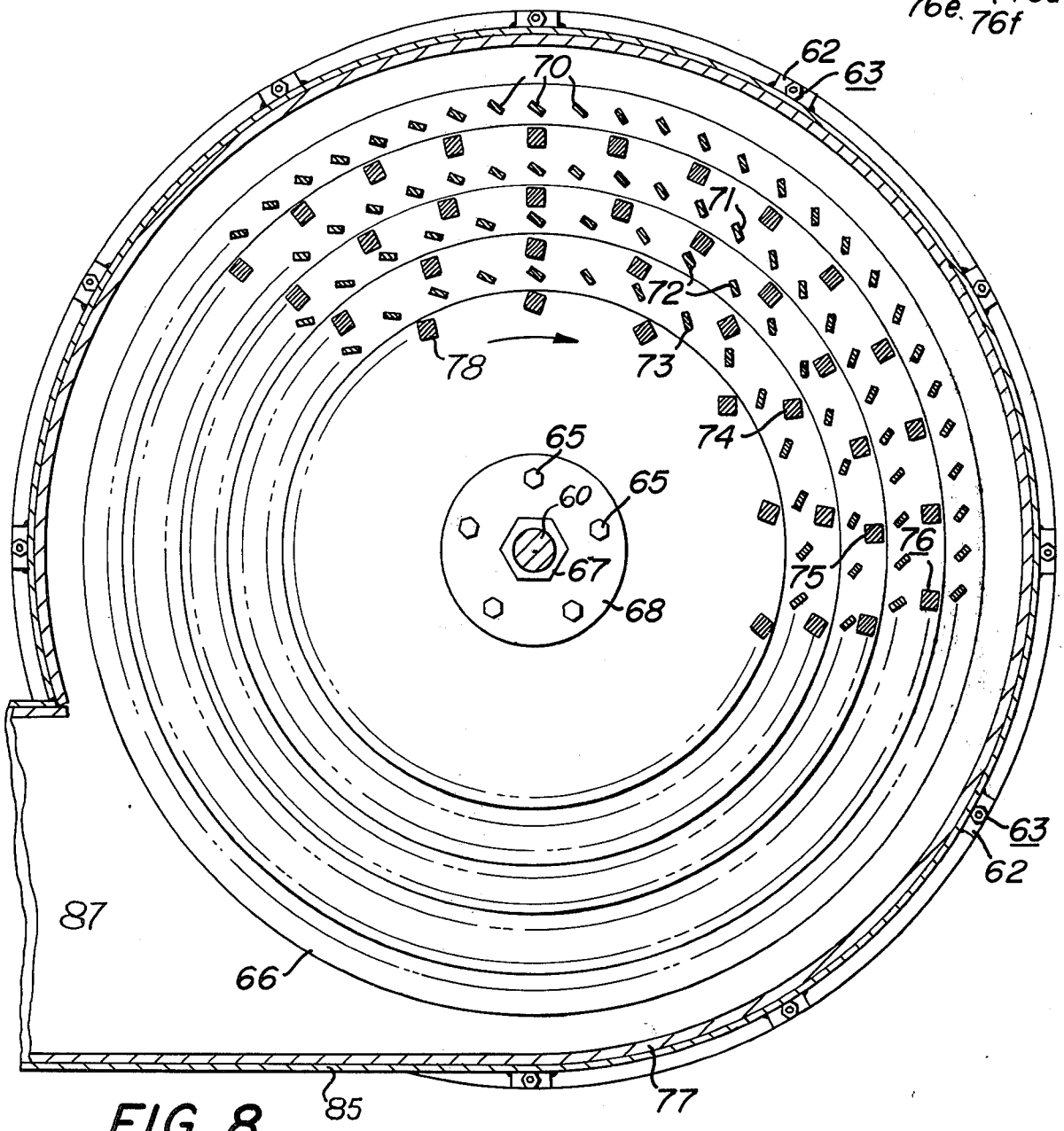
FIG. 8 is a sectional view taken along the section line 8—8 of FIG. 7 in the direction indicated.

As may be seen from FIG. 8, the cross-sections of the rotor impactors are generally square whereas the cross-sections of the stator impactors are substantially rectangular. Also, it is seen that the innermost row of impactors of the rotor 78 have leading surfaces disposed at about 45° and successive rows of impactors are disposed at progressively lesser angles so that the outermost row of impactors 76 has a surface which is substantially at right angles to a radius drawn from the center of the rotor shaft.

In this embodiment, the stator impactors 70–73 are different from the stator impactors of the previous embodiment. The stator impactors here are not intended primarily to be adjustable. Each has a top or outer end portion such as portion **70*a*, which is provided with threads on its side surface to engage corresponding threads in the sides 81, 82 of the rotor housing. As shown, each is provided with a slot to enable a screw driver or the like to screw in the impactor through the aligned holes in the reinforcing annuli 79. To the extent that adjustability is desired, a spring lock washer could be inserted just inwardly of the head 70*a* to allow the impactor to be adjusted in orientation at least within the circumference of the final turn or turns of the threads. Of course, the top portion 70***a* could alternatively be provided with a hexagonal or other conventional shape to permit wrench tightening and removal.

In this second embodiment, since the laminated rotor has square holes broached in them through which the rotor impactors may be inserted from either side, they are no longer angularly adjustable as they could be in the first embodiment wherein round holes and bolt-spring washer retaining means were used.

It is not necessary that the spring-urged ball detent of the rotor impactors (FIG. 9) be located off-center of the top square face of the central portion 76*g*, nor that the arcuate cut-out 66*p* be correspondingly located within the square hole within 66*m*. However, this does help to insure that the impactor 76 will be inserted so that the plates 76*e*, 76*d* and bar 76*c* will be exposed striking faces of the impactor.

The first embodiment of the invention having adjustable stator impactors and adjustable rotor impactors provides a great deal of flexibility in various comminution operations. The stator impactors may have their orientation established, unlike other machines, while the machine is operating under pressure by choosing the proper geometry of the stators, changes in their angular orientation changes the particle intersection angle to modify the degree of impact, to cause sliding abrasion or to cause a cutting action. The stators may have an alternate face with a roundish contour to modify the impact action and then countered by the particle. It has been found that a wide flat surface oriented at 90° to the flight path of the particles being processed will give optimum shattering action while an angled or rounded surface will give more of an abrading action. If the impactor is provided with a narrow edge facing the particle, this minimizes the opportunity for any shattering or abrasion.

These adjustments not only allow modification of grind characteristics, but also allow a change in the amount of size reduction at constant speed. This, therefore, makes a constant speed machine more flexible as a processing unit. Since adjustment of the stators can be accomplished without their removal, the efficiency of the material coming into contact with the stator impactors is maintained.

What is claimed is:

1. Rotary processing apparatus comprising, in combination:

(a) a rotor housing, (b) a rotary spindle adapted to be driven by a power source and having one end thereof passing through an aperture in said housing.

(c) a fabricated rotor in said housing attached to said spindle, said rotor comprising a first purality of processing members attached to at least three substantially flat, generally centrally apertured members arranged in a stack with said apertures being aligned, said spindle being mounted to pass through a predetermined number of said apertures, said flat members being substantially in contact with one another from the region where the rotor is attached to said spindle and extending radially outward therefrom, and (d) means mounted on said spindle for retaining said stack on said spindle in releasable securement.

2. The apparatus according to claim 1 wherein said processing members are disposed generally transversely to the planes of said flat members.

3. The apparatus according to claim 1 wherein said substantially flat rotor members are generally annular.

4. The apparatus according to claim 3 wherein said stack includes annular members having different radii.

5. The apparatus according to claim 4 wherein a predetermined number of said annular members which are in the middle of said stack have the largest radii and the radii of the annular members adjacent thereto are progressively smaller.

6. The apparatus according to claim 1 wherein said rotor housing has a stationary stack of contiguous substantially flat, generally centrally apertured members disposed adjacent one inner surface of said rotor housing and disposed substantially concentrically with said stack of said rotor members.

7. The apparatus according to claim 6 wherein said flat members of said second stack are bolted to one another and to said rotor housing.

8. The processing apparatus according to claim 6 wherein said stationary stack and said rotor stack of apertured members have respectively tapered contours and wherein said tapered contours are complementary so that the average cross-section of the volume between said stacks is substantially constant.

9. The apparatus according to claim 1 wherein said rotor housing includes apertured means which are engaged by a second plurality of processing members extending into said rotor housing from outside, said second plurality of processing members having exterior parts engageable from outside said housing for changing the axial orientation of said members of said second plurality.

10. The processing apparatus according to claim 9 wherein said first and second pluralities of processing members are interdigitated.

11. The apparatus according to claim 1 wherein said spindle is disposed substantially vertical and said rotor stack is disposed substantially horizontal.

12. The processing apparatus according to claim 1 wherein said spindle is substantially horizontal and said rotor stack is substantially vertical.

13. The apparatus according to claim 12 wherein means are provided associated with said rotor housing for applying material to be processed simultaneously to both sides of said rotor.

14. The processing apparatus according to claim 12 wherein said rotor stack is provided with double-ended rotary processing members which penetrate said stack.

15. The processing apparatus according to claim 14 wherein said double-ended processing members are impacting members.

16. The processing apparatus according to claim 15 with the addition of a second plurality of processing members which are stationary and have axes substantially transverse to said rotor stack and extending inwardly from at least one wall of said rotor housing.

17. The processing apparatus according to claim 16 wherein said second plurality of processing members comprise two sets of stator members extending transversely inward from opposite walls of said rotor housing and arranged in interdigitating relationship to the processing members of said rotor.

18. The apparatus according to claim 1 wherein there is at least one processing member attached to all of said plurality of flat members.

* * * * *